US011021180B2

(12) United States Patent
Harp et al.

(10) Patent No.: US 11,021,180 B2
(45) Date of Patent: Jun. 1, 2021

(54) RAILWAY ROAD CROSSING WARNING SYSTEM WITH SENSING SYSTEM ELECTRICALLY-DECOUPLED FROM RAILROAD TRACK

(71) Applicant: Siemens Mobility, Inc., New York, NY (US)

(72) Inventors: Brian Harp, New Albany, IN (US); Holger Schmidt, Saint Johns, FL (US); Stefan Fritschi, Louisville, KY (US); Jay Yocum, Nabb, IN (US)

(73) Assignee: Siemens Mobility, Inc., New York, NY (US)

( * ) Notice: Subject to any disclaimer, the term of this patent is extended or adjusted under 35 U.S.C. 154(b) by 321 days.

(21) Appl. No.: 15/947,143

(22) Filed: Apr. 6, 2018

(65) Prior Publication Data

US 2019/0308649 A1 Oct. 10, 2019

(51) Int. Cl.

| | |
|---|---|
| ***B61L 29/28*** | (2006.01) |
| ***B61L 25/02*** | (2006.01) |
| ***B61L 29/22*** | (2006.01) |
| ***B61L 29/30*** | (2006.01) |

(52) U.S. Cl.

CPC ..... *B61L 29/28* (2013.01); *B61L 25/02* (2013.01); *B61L 29/22* (2013.01); *B61L 29/30* (2013.01)

(58) Field of Classification Search

CPC ..... B61L 29/22; B61L 29/28; B61L 29/30; B61L 25/02

USPC ..... 246/126

See application file for complete search history.

(56) References Cited

U.S. PATENT DOCUMENTS 4,283,031 A * 8/1981 Finch ..... B61L 1/10 246/128
5,554,982 A * 9/1996 Shirkey ..... B61L 3/004 246/122 R
5,620,155 A * 4/1997 Michalek ..... B61L 29/24 246/121

(Continued)

FOREIGN PATENT DOCUMENTS

CA 2528568 A1 5/2007
JP 2009001162 A 1/2009

(Continued)

*Primary Examiner* — Zachary L Kuhfuss

(57) ABSTRACT

A railway road crossing warning system (10) including a railway road crossing control unit (18) that may be selectively set to a primary or a secondary mode of operation is provided. In the primary mode of operation, the railway road crossing control unit is responsive to a primary activation signal (21) received from a primary activation-signal source (22), such as a positive train control (PTC) system. In the event the primary activation signal from the primary activation-signal source is not available, railway road crossing control unit (18) is set to the secondary mode of operation, where the railway road crossing control unit is responsive to one or more signals (25) received from a secondary activation-signal source (26) including a railway-vehicle sensing system (28) electrically-decoupled from a railroad track (12). Disclosed embodiments maintain operational robustness in the presence of changing weather and avoid variable electrical ballast conditions that otherwise could develop across the rails, while providing a cost-effective and reliable backup capability for a PTC-started crossing system.

3 Claims, 5 Drawing Sheets

(56) References Cited

U.S. PATENT DOCUMENTS 5,699,986 A * 12/1997 Welk ..... B61L 29/24 246/122 R
5,735,491 A * 4/1998 Atkinson ..... B61L 29/246 246/124
5,735,492 A 4/1998 Pace
5,757,291 A * 5/1998 Kull ..... B61L 25/025 340/988
5,864,304 A * 1/1999 Gerszberg ..... B61L 29/18 246/122 R
5,924,651 A * 7/1999 Penza ..... B61L 23/06 246/124
6,179,252 B1 * 1/2001 Roop ..... B61L 29/18 246/122 R
6,371,417 B1 * 4/2002 Southon ..... B61L 1/165 246/247
6,471,162 B1 * 10/2002 Pace ..... B61L 23/06 246/124
6,915,191 B2 7/2005 Kane et al.
7,075,427 B1 * 7/2006 Pace ..... B61L 23/06 246/125
7,079,926 B2 * 7/2006 Kane ..... B61L 3/008 246/14
7,196,636 B2 * 3/2007 Graham ..... B61L 29/28 246/122 R
7,254,467 B2 8/2007 Fries et al.
7,467,032 B2 * 12/2008 Kane ..... B61L 15/0027 104/307
8,175,764 B2 * 5/2012 Kernwein ..... B61L 25/025 246/121
8,214,091 B2 * 7/2012 Kernwein ..... B61L 25/025 701/19
8,596,587 B2 12/2013 Hilleary
8,668,169 B2 * 3/2014 Nichter ..... B61L 25/021 246/125
8,752,797 B2 * 6/2014 Carlson ..... B61L 1/164 246/122 R
9,193,367 B2 11/2015 Hilleary
10,479,381 B2 * 11/2019 Fries ..... B61L 23/005
10,665,118 B2 * 5/2020 Hilleary ..... B61L 29/30
2006/0180712 A1 8/2006 Hill
2013/0194423 A1 * 8/2013 Baines ..... B61L 29/30 348/148
2013/0256466 A1 * 10/2013 Carlson ..... B61L 29/30 246/218
2014/0218482 A1 8/2014 Prince
2014/0346285 A1 * 11/2014 Carlson ..... B61L 1/181 246/127
2016/0189552 A1 * 6/2016 Hilleary ..... B61L 29/30 246/125
2016/0200334 A1 * 7/2016 Hilleary ..... G08G 1/097 246/218
2016/0339934 A1 11/2016 Chung et al.
2019/0135316 A1 * 5/2019 Hilleary ..... B61L 27/0088
2019/0135317 A1 * 5/2019 Hilleary ..... B61L 27/0088
2019/0308649 A1 * 10/2019 Harp ..... B61L 29/224
2019/0337543 A1 * 11/2019 Corbo ..... B61L 29/28

FOREIGN PATENT DOCUMENTS

WO 2014059487 A1 4/2014
WO 2016202575 A1 12/2016

* cited by examiner

RAILWAY ROAD CROSSING WARNING SYSTEM WITH SENSING SYSTEM ELECTRICALLY-DECOUPLED FROM RAILROAD TRACK

BACKGROUND

1. Field

Disclosed embodiments are generally related to railway road crossing warning systems and, more particularly, to a system for detecting presence and movement of a railway vehicle within a detection area of a railroad track, and control of the railway road crossing warning system using a railway-vehicle sensing system electrically-decoupled from the railroad track.

2. Description of the Related Art

Railway road crossing warning systems provide protection of crossings by detecting train presence and motion, and activating crossing warning devices such as bells, lights, crossing gate arms, within a specified time period before the arrival of a train at the road crossing. Train presence near the crossing and motion towards/away from the crossing has been traditionally detected by transmitting electrical signals on the railroad tracks. For example, train presence may be detected by receiving a voltage as propagated over the railroad track, as a transmission medium. Train motion may be determined by monitoring the current and voltage applied to the railroad track to determine the impedance of the track, from the crossing to the train. See U.S. Pat. No. 7,254,467 and International Publication Number WO 2014/059487 A1 for respective examples of railway road crossing warning systems.

BRIEF DESCRIPTION

One disclosed embodiment is directed a railway road crossing warning system including a railway-vehicle sensing system electrically-decoupled from a railroad track where a railway-vehicle travels. A railway road crossing control unit is responsive to at least one signal received from the railway-vehicle sensing system to process the received at least one signal and determine whether the railway-vehicle is in a detection area of the railroad track. The railway road crossing control unit is configured to activate at least one crossing warning device upon determining, based on the received at least one signal, a presence of the railway-vehicle in the detection area of the railroad track, and is further configured to deactivate said at least one crossing warning device upon determining, based on the received at least one signal, an absence of the railway-vehicle from the detection area of the railroad track.

Another disclosed embodiment is directed to a railway road crossing warning system including a railway road crossing control unit that may be selectively set by a mode selector unit to a primary mode of operation or a secondary mode of operation. In the primary mode of operation, the railway road crossing control unit is responsive to a primary activation signal received from a primary activation-signal source, such as a positive train control (PTC) system, to activate the at least one crossing warning device.

In the event the activation signal from the primary activation-signal source is not available, the railway road crossing control unit is set by the mode selector unit to the secondary mode of operation. In the secondary mode of operation, the railway road crossing control unit is responsive to at least one signal received from a secondary activation-signal source.

The secondary activation signal-source comprises a railway-vehicle sensing system electrically-decoupled from a railroad track where a railway-vehicle travels. The railway road crossing control unit is configured to process the received at least one signal and determine whether the railway-vehicle is within a detection area of the railroad track. The railway road crossing control unit is configured to activate the least one crossing warning device upon determining, based on the received at least one signal, a presence of the railway-vehicle in the detection area of the railroad track, and is further configured to deactivate the at least one crossing warning device upon determining, based on the received at least one signal, an absence of the railway-vehicle from the detection area of the railroad track.

DETAILED DESCRIPTION

Figure 1:
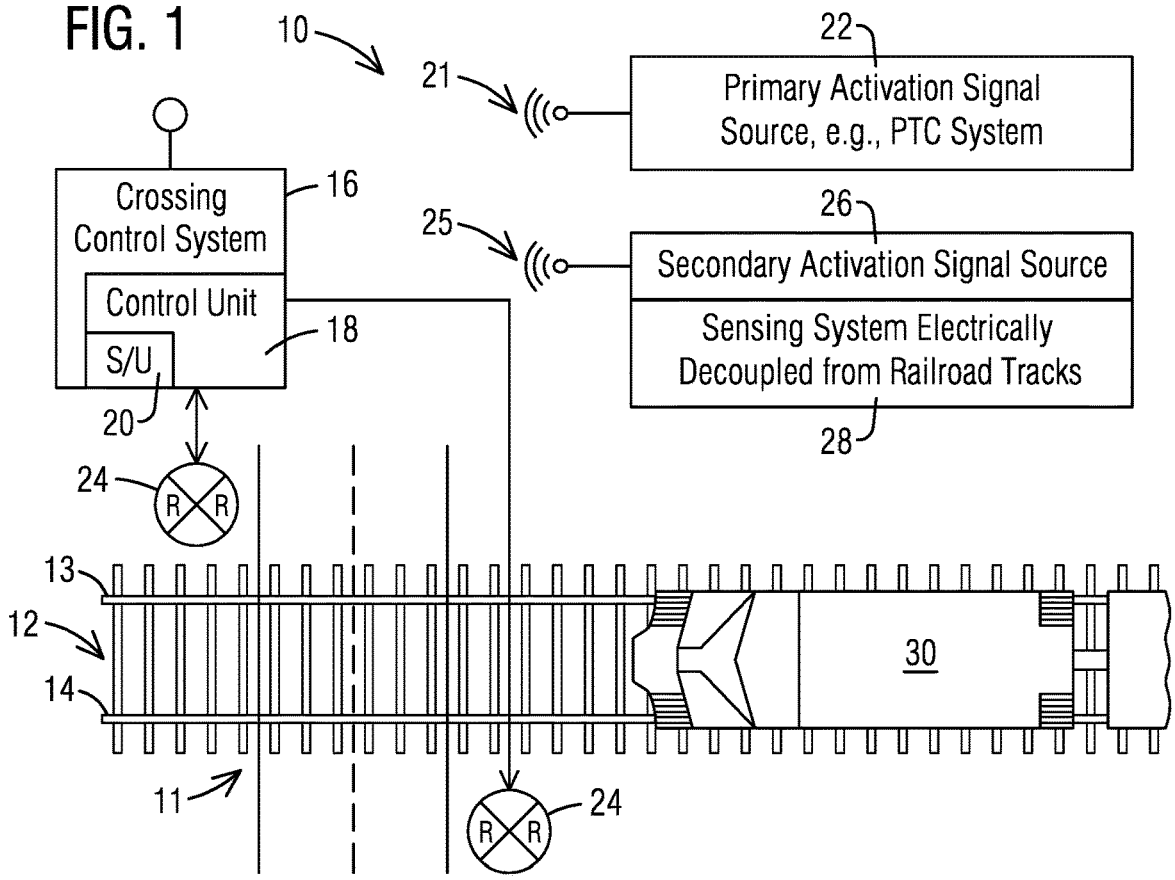
FIG. 1 is a top-level schematic of a railway road crossing warning system embodying disclosed concepts.

Without limiting disclosed embodiment to any particular jurisdiction, in view of requirements mandated in the United States by the Federal Railroad Administration (FRA), the railroad industry in the United States has made a substantial investment in the infrastructure needed to implement a Positive Train Control (PTC) system. Consequently, the railroad industry has pursued applications to leverage that investment into other areas beyond the original mandate of train control to increase safety and operating efficiency in such other areas. One known application is to use train position and speed knowledge obtained by the PTC system to activate the grade crossing warning devices. This eliminates wired connections to the track rails and makes the system robust in the presence of changing weather and avoids variable electrical ballast conditions that otherwise would develop across the rails. This also makes the system impervious to alternating current (AC) electrical interference that can develop across the rails.

The inventors of the present invention have recognized some practical limitations regarding the foregoing application of the PTC system. For instance, in this application of the PTC system, there is no longer the ability to use traditional island circuits to activate the grade crossing warning devices. This is not an issue so long as the PTC system is fully functional; however, there will be instances when the PTC system may not be available for any one of a variety of reasons. Based on typical designs of current grade crossing warning systems, in these instances, one may need to rely on cumbersome techniques for activating the grade crossing warning devices in the absence of a PTC actuating signal. These techniques may involve train stoppage, which decreases efficiency of railroad operation regarding both timeliness and energy consumption. Additionally, train stoppage increases a possibility of cargo damage on the train.

In view of such recognition, the present inventors propose an innovative technical solution involving no wired connections to the track rails. The proposed technical solution maintains robustness in the presence of changing weather and avoids variable electrical ballast conditions that otherwise would develop across the rails, while providing a cost-effective and reliable backup capability for a PTC-started crossing system.

In the following detailed description, various specific details are set forth in order to provide a thorough understanding of such embodiments. However, those skilled in the art will understand that disclosed embodiments may be practiced without these specific details that the aspects of the present invention are not limited to the disclosed embodiments, and that aspects of the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

FIG. 1 is a top-level schematic of a railway road crossing warning system 10 embodying disclosed concepts. As will be appreciated by those skilled in the art, railway road crossing warning system 10 may be used in connection with a road crossing 11 that intersects a portion of a railroad track 12, such as may be made up of a pair of track rails 13 and 14. For the sake of simplicity of illustration, the figures illustrate just a singular railroad track disposed perpendicular relative to the road crossing. It should be appreciated that disclosed embodiments are not limited to singular railroad tracks, or to any particular geometric arrangement between the railroad track and the road crossing.

In one non-limiting embodiment, a crossing control system 16 includes a railway road crossing control unit 18 that may be selectively set by a mode selector unit 20 (labeled S/U in the drawings) to a primary mode of operation or a secondary mode of operation. In the primary mode of operation, the railway road crossing control unit is responsive to a primary activation signal 21 received from a primary activation-signal source 22, as may be generated, without limitation, from a positive train control (PTC) system, to activate at least one crossing warning device 24, as may include bells, lights, crossing gate arms, etc.

In this primary mode, when a railway-vehicle 30, e.g., a train, approaches crossing 11, continuous location-tracking and time of arrival calculations performed by the PTC system may be used to generate primary activation signal 21 conveyed to railway road crossing control unit 18 and in turn activate crossing warning device/s 24 at an appropriate time, such as may be configured to ensure an optimum advanced activation time.

In the event primary activation signal 21 from primary activation-signal source 22 is not available, (e.g., PTC system down) railway road crossing control unit 18 is set by mode selector unit 20 to the secondary mode of operation, where railway road crossing control unit 18 is responsive to at least one signal 25 received from a secondary activation-signal source 26.

The secondary activation signal-source includes a railway-vehicle sensing system 28 electrically-decoupled from railroad track 12, where railway-vehicle 30 travels. Non-limiting examples may be railway-vehicles, such as a train, involving a series of connected railway-vehicles, that runs along railroad track 12 to transport cargo or passengers. Other non-limiting examples of railway-vehicles may be discrete railway-vehicles, such as may be used for maintenance of the railroad tracks and other applications.

As elaborated in greater detail below, railway road crossing control unit 18 may be configured to process the received signal/s 25 from railway-vehicle sensing system 28 and determine whether railway-vehicle 30 is within a detection area of the railroad track. It will be appreciated that the size and configuration of the detection area may be appropriately tailored based on the needs of a given application.

Without limitation, railway road crossing control unit 18 may be configured to activate crossing warning device/s 24 upon determining, based on the received signal/s 25, a presence of the railway-vehicle in the detection area of the railroad track. Railway road crossing control unit may be further configured to deactivate crossing warning device/s 24 upon determining, based on the received signal/s 25, an absence of railway-vehicle 30 from the detection area of the railroad track. The description below will proceed to describe various disclosed embodiments of railway-vehicle sensing system 28 that may be used alone, or in combination, if so desired.

Figure 2:
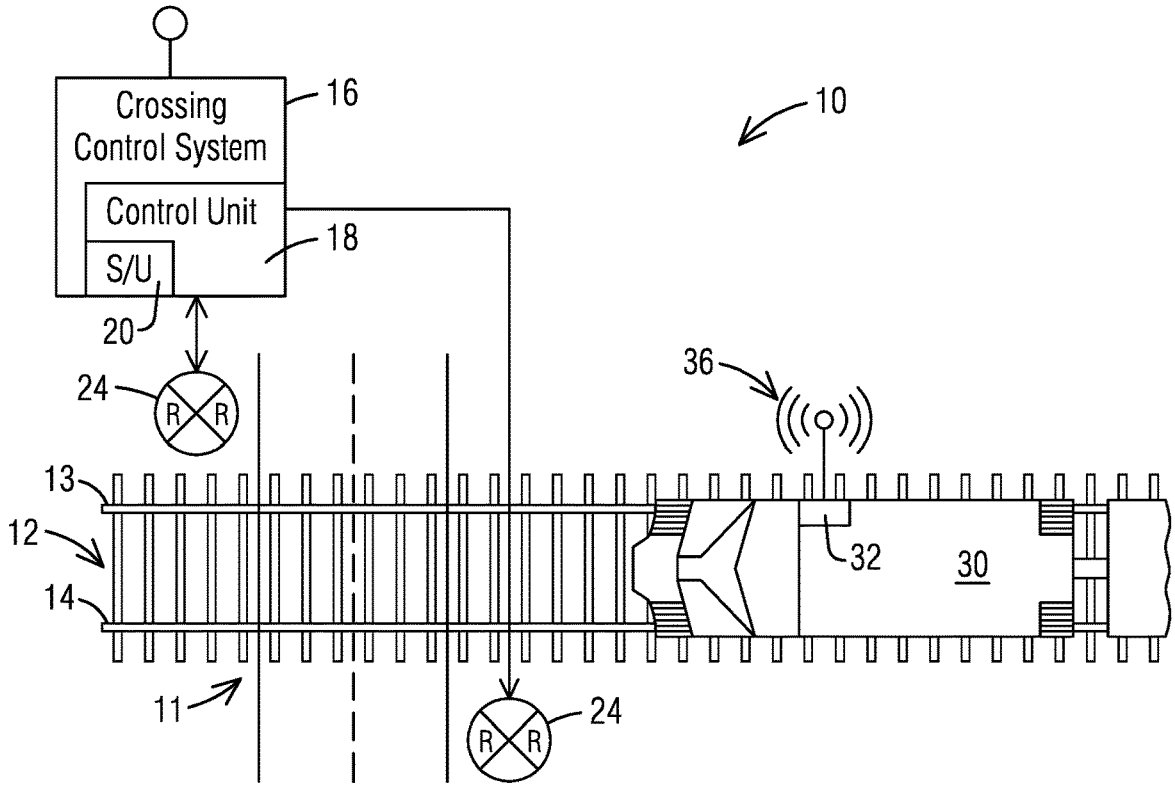
FIGS. 2-4 respectively illustrate an example flow sequence of events in connection with a railway road crossing warning system involving one non-limiting embodiment of a disclosed railway-vehicle sensing system.
Figure 3:
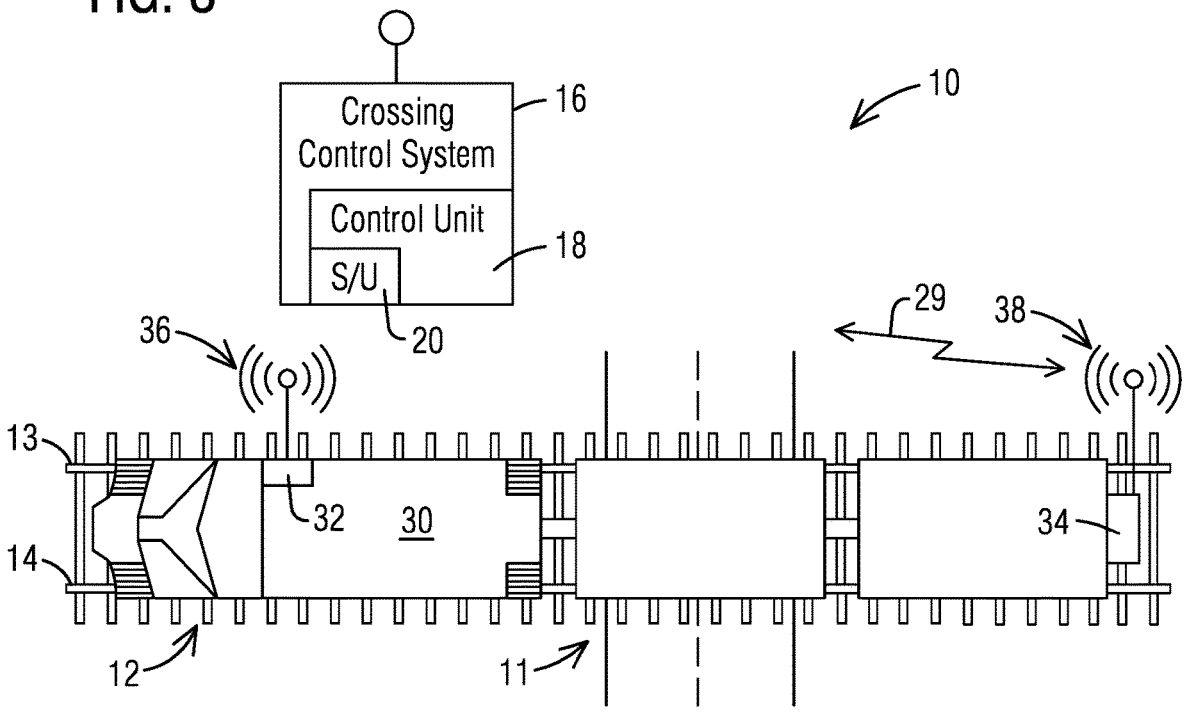
Figure 4:
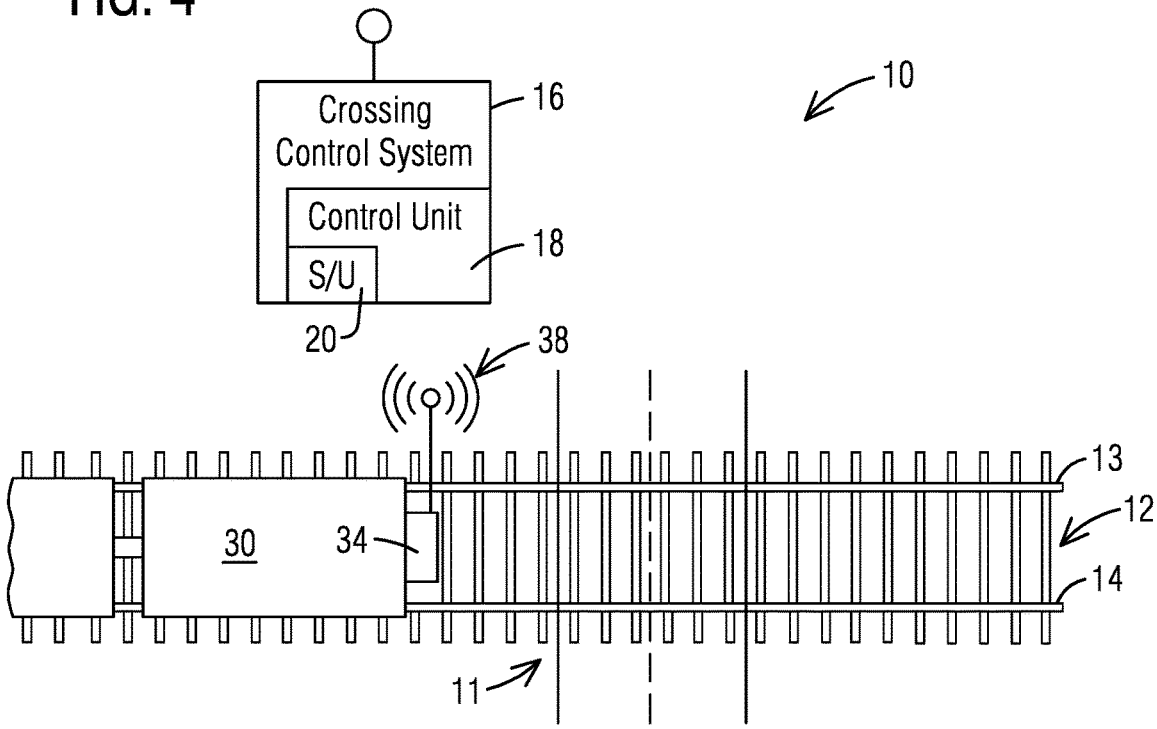

FIGS. 2-4 respectively illustrate an example flow sequence of events in connection with one non-limiting embodiment of a disclosed railway-vehicle sensing system 28 (FIG. 1), such as may involve a wireless telemetry link 29 (FIG. 3) formed by a telemetry system onboard railway-vehicle 30, such as in a train. As will be appreciated by those skilled in the art, such telemetry system may include a head-of-train (HOT) electronic device 32 and an end-of-train (EOT) electronic device 34 (FIG. 3) and may be part of train equipment that may be customarily used for monitoring, for example, brake pipe pressure information and initiate emergency operation of a braking system in the train. HOT and EOT electronic devices 32 and 34 operate at two different frequencies allowing for full duplex communication. These frequencies are allocated to the railroad industry and are substantially immune to from external interference.

In one non-limiting embodiment, as train 30 approaches crossing 11, as schematically illustrated in FIG. 2, a signal 36 from HOT electronic device 32 may be detected and processed by railway road crossing control unit 18 to determine entry of the train in the detection area of the railroad track. Without limitation, when the level of signal 36 is at or exceeds a certain threshold limit value, then this would allow making a determination of entry of the train in the detection area of the railroad track, and railway road crossing control unit 18 would activate crossing warning device/s 24.

As train 30 passes continues to pass over crossing 11, as schematically illustrated in FIG. 3, signal 36 from HOT electronic device 32 and signal 38 from EOT electronic device 34 may be detected and processed by railway road crossing control unit 18 to determine a continued presence of the train in the detection area of the railroad track. By way of example and without limitation, when the respective levels of signals 36, 38 are within a certain range of values, then this would allow making a determination of continued presence of the train in the detection area of the railroad track, and railway road crossing control unit 18 would continue to maintain activation of crossing warning device/s 24.

As train 30 continues to eventually depart from the crossing, as schematically illustrated in FIG. 4, signal 38 from EOT electronic device 34 may be detected and processed by railway road crossing control unit 18 to determine departure of the train from the detection area of the railroad track. By way of example and without limitation, when the respective level of signal 38 is below a certain threshold limit value, then this would allow making a determination of departure of the train from the detection area of the railroad track, and railway road crossing control unit 18 would deactivate crossing warning device/s 24. It will be appreciated that this embodiment would allow the train to pass through the crossing at a permissible speed, even if the PTC system is bypassed for train control purposes.

Figure 5:
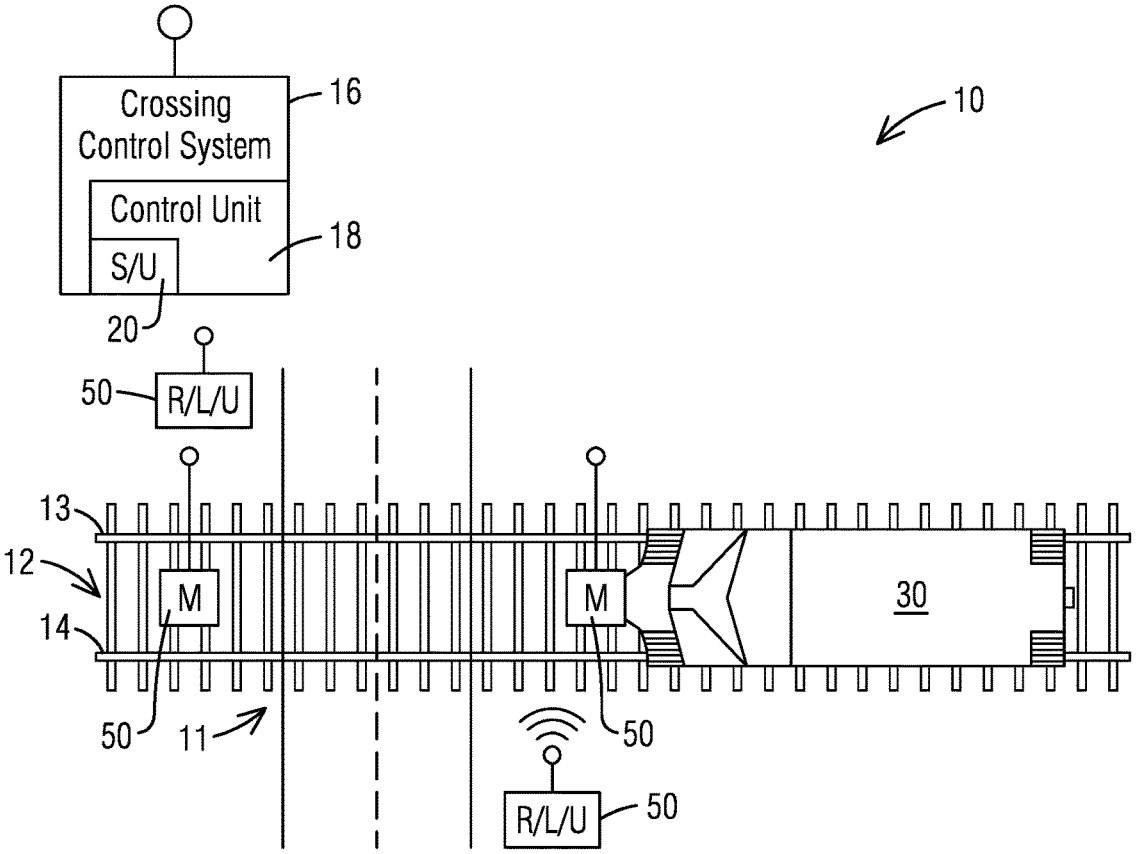
FIGS. 5-7 respectively illustrate an example flow sequence of events in connection with a railway road crossing warning system involving another non-limiting embodiment of a disclosed railway-vehicle sensing system.
Figure 6:
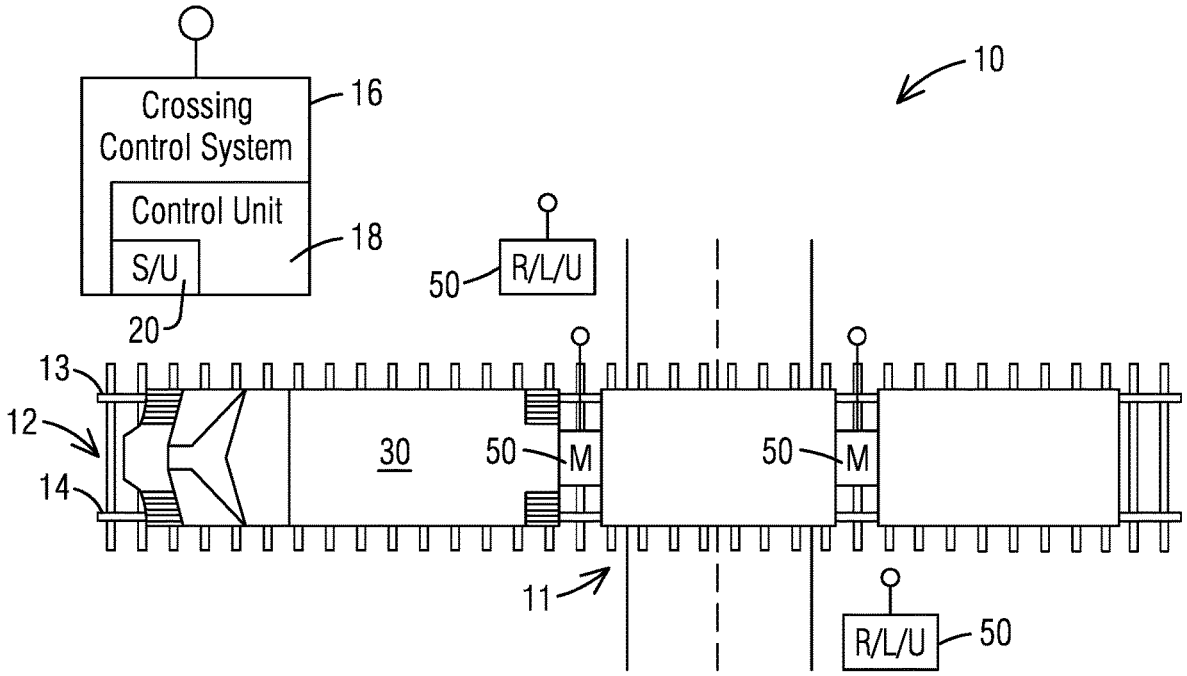
Figure 7:
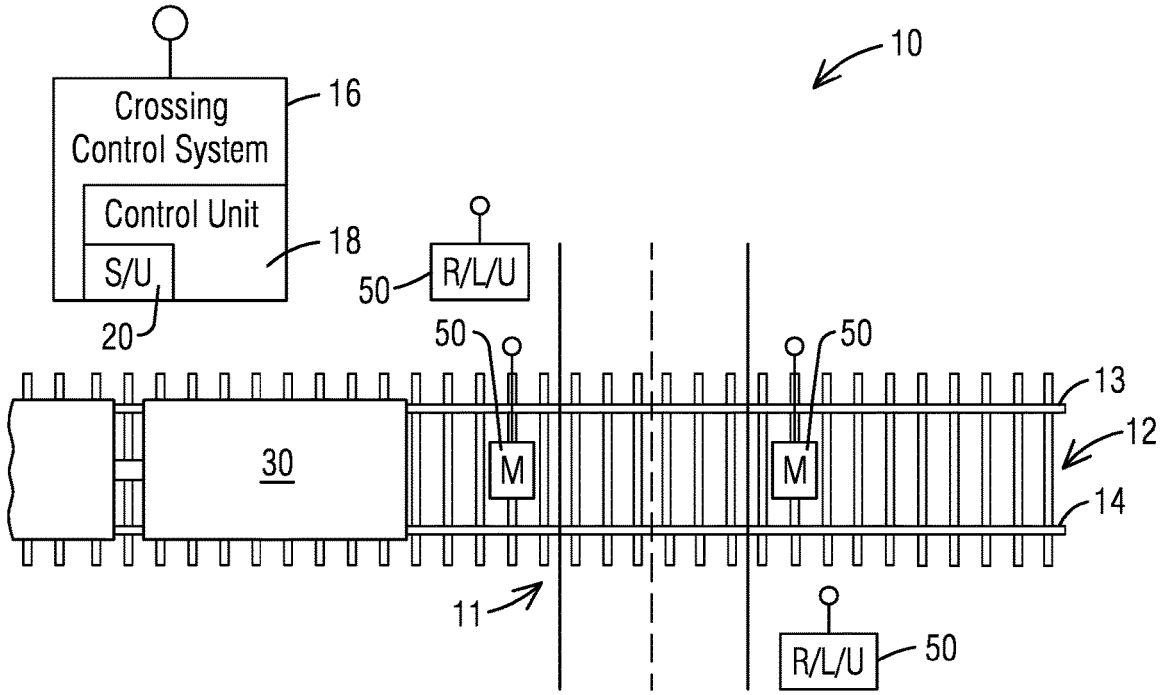

FIGS. 5-7 respectively illustrate an example flow sequence of events in connection with another non-limiting embodiment of a disclosed railway-vehicle sensing system 28 (FIG. 1), as may involving wireless sensors 50 appropriately arranged to monitor the detection area of the railroad track. Non-limiting examples of wireless sensors 50 may include magnetometer sensors (labeled M in the figures), radar sensors, lidar sensors, ultrasonic sensors (collectively labeled R/L/U in the figures), and a combination of two or more different types of such wireless sensors.

In one non-limiting embodiment, as train 30 approaches crossing 11, as schematically illustrated in FIG. 5, upon at least some of the respective wireless sensors 50 (e.g., wireless sensors proximate an entrance side of the detection area) sensing entry of the railway-vehicle in the detection area of the railroad track, railway road crossing control unit 18 would activate crossing warning device/s 24.

As train 30 continues to pass over crossing 11, as schematically illustrated in FIG. 6, respective wireless sensors 50 would continue to sense presence of the train in the detection area of the railroad track, and railway road crossing control unit 18 would continue to maintain active crossing warning device/s 24.

As train 30 continues to eventually depart from the crossing, as schematically illustrated in FIG. 7, at least some of the respective wireless sensors (e.g., wireless sensors proximate an exit side of the detection area) would sense departure of the train from the detection area of the railroad track, and railway road crossing control unit 18 would deactivate crossing warning device/s 24. It will be appreciated that this embodiment would also allow trains to pass through the crossing at a permissible speed, even if the PTC system is bypassed for train control purposes. Additionally, this embodiment provides control of crossing warning device/s 24 for railway vehicles that may not be equipped with the telemetry system discussed above in the context of FIGS. 2-4. Moreover, this embodiment is not contingent on functionality of equipment onboard the passing train.

Figure 8:
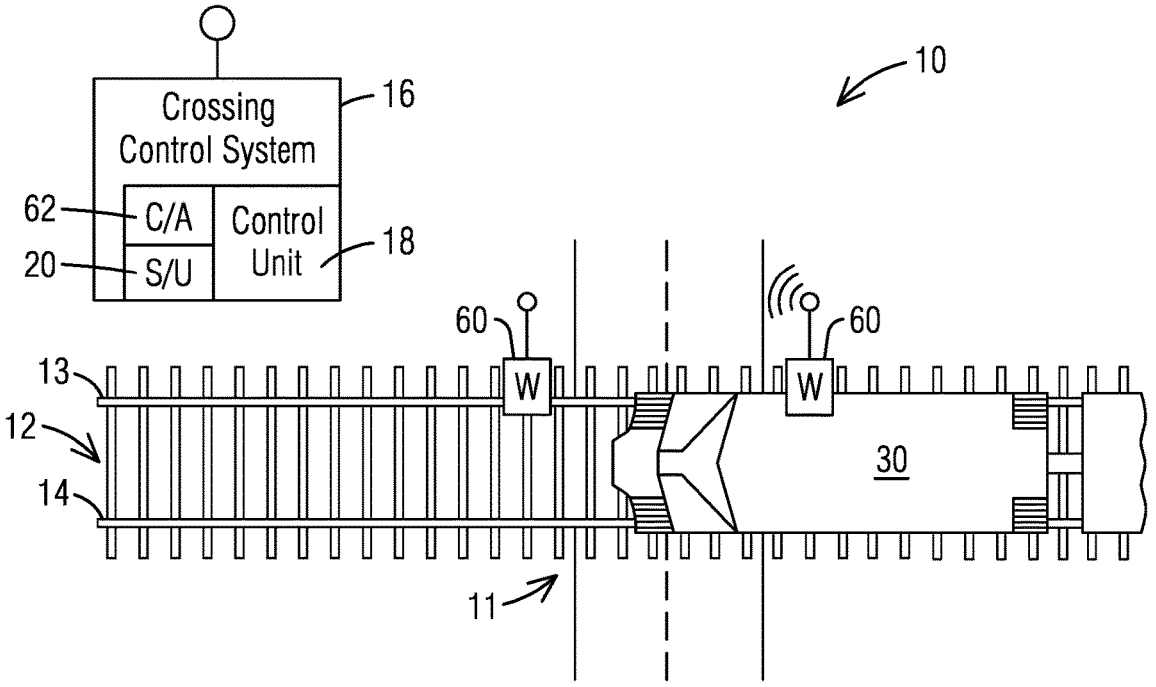
FIGS. 8-10 respectively illustrate an example flow sequence of events in connection with a railway road crossing warning system involving still another non-limiting embodiment of a disclosed railway-vehicle sensing system.
Figure 9:
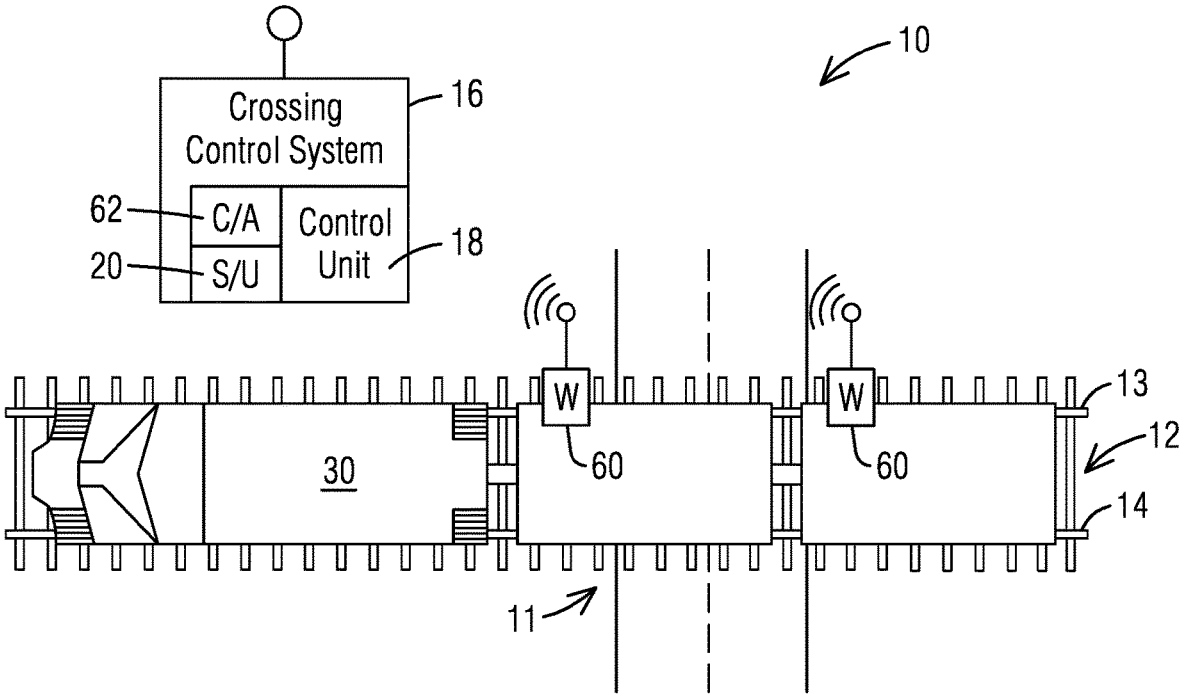
Figure 10:
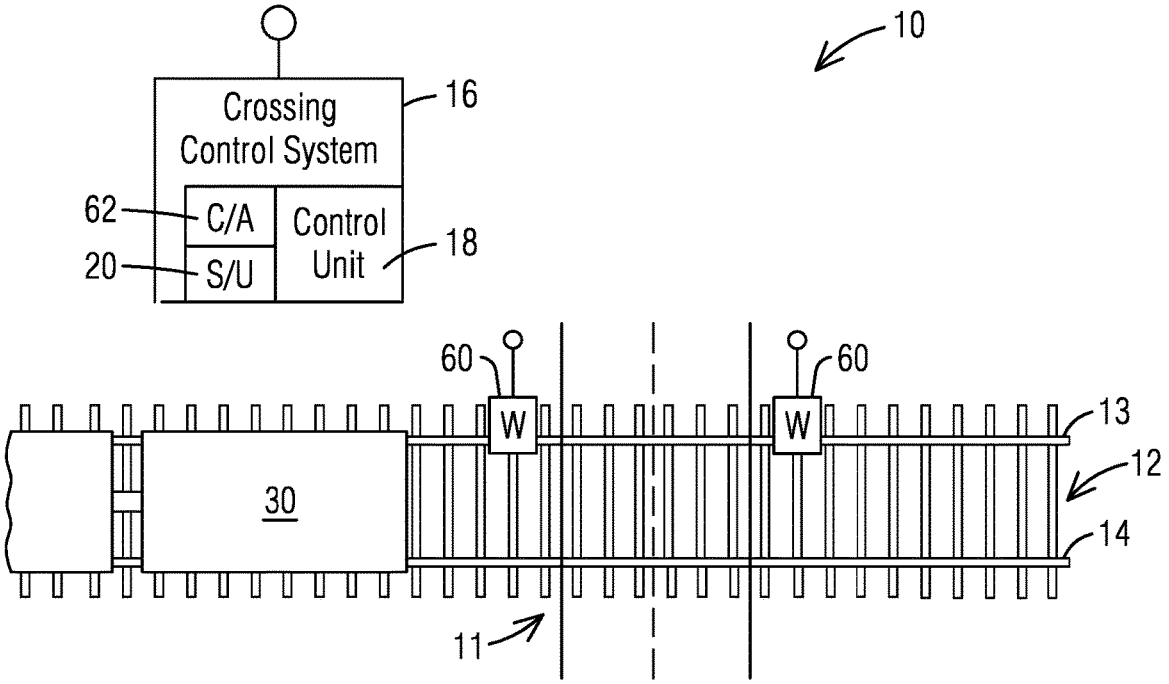

FIGS. 8-10 respectively illustrate an example flow sequence of events in connection with still another non-limiting embodiment of a disclosed railway-vehicle sensing system 28 (FIG. 1) involving wheel-sensing and/or axle-sensing devices 60, (labeled W in the drawings) such as may be disposed at opposite sides of the detection area of the railroad track. As would be appreciated by one skilled in the art, wheel-sensing and/or axle-sensing devices 60 would be mechanically mounted onto the rails but would not be electrically coupled to the rails, (no electrical connection), and therefore eliminating the effects of weather and ballast leakage variances that occur in prior art sensing systems that involve electrical connections with the rails.

In one non-limiting embodiment, as railway vehicle 30 approaches crossing 11, as schematically illustrated in FIG. 8, when a first axle of the railway vehicle passes over a sensing device 60 disposed at an entrance of the detection area of the railroad track, railway road crossing control unit 18 would activate crossing warning device/s 24. By way of example and without limitation, a counter arrangement 62 (labeled C/A in the drawings) in railway road crossing control unit 18 would indicate a positive count at this point. For instance, counter arrangement 62 may include a counter to additively register counts from a sensing device 60 disposed at an entrance side of the detection area of the railroad track. Counter arrangement 62 may be programmed to substractively register counts from a sensing device 60 disposed at an exit side of the detection area of the railroad track.

As train 30 continues to pass over the crossing, as schematically illustrated in FIG. 9, respective axles of the railway vehicle would continue to be respectively counted in and out as the respective axles of the railway vehicle pass over the respective wheel-sensing and/or axle-sensing devices 60. As long as the axle count is positive in counter arrangement 62, this would indicate presence of the railway vehicle in the detection area of the railroad track railway and road crossing control unit 18 would continue to maintain activated crossing warning device/s 24.

As train 30 departs from the crossing, as schematically illustrated in FIG. 10, without limitation, when a last axle of the train passes over a sensing device 60 disposed at the exit side of the detection area of the railroad track, at this point, counter arrangement 62 would indicate a zero count and railway road crossing control unit 18 would deactivate crossing warning device/s 24. This embodiment, like the embodiment discussed in the context of FIGS. 5-7, provides control of crossing warning device/s 24 for railway vehicles that may not be equipped with the telemetry system discussed above in the context of FIGS. 2-4.

In operation, disclosed embodiments offer an innovative technical solution in railway road crossing warning system that involves no wired connections to the track rails. Disclosed embodiments maintain operational robustness in the presence of changing weather and avoid variable electrical ballast conditions that otherwise could develop across the rails, while providing a cost-effective and reliable backup capability for a PTC-started crossing system.

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. A railway road crossing warning system comprising:

a railway-vehicle sensing system electrically-decoupled from a railroad track where a railway-vehicle travels; and a railway road crossing control unit responsive to at least one signal received from the railway-vehicle sensing system to process the received at least one signal and determine whether the railway-vehicle is in a detection area of the railroad track, wherein the railway road crossing control unit is configured to activate at least one crossing warning device upon determining, based on the received at least one signal, a presence of the railway-vehicle in the detection area of the railroad track, and wherein the railway road crossing control unit is further configured to deactivate said at least one crossing warning device upon determining, based on the received at least one signal, an absence of the railway-vehicle from the detection area of the railroad track, wherein the railway-vehicle comprises a train, and wherein the railway-vehicle sensing system comprises a wireless telemetry link comprising a head-of-train electronic device and an end-of-train electronic device, wherein the at least one signal received by the railway road crossing control unit comprises a signal from the head-of-train electronic device processed by the railway road crossing control unit to determine entry of the train in the detection area of the railroad track, and wherein the at least one signal received by the railway road crossing control unit further comprises a signal from the end-of-train electronic device processed by the railway road crossing control unit to determine departure of the train from the detection area of the railroad track.

2. The railway road crossing warning system of claim 1, wherein the railway road crossing control unit is further responsive to an activation signal from a positive train control system configured to activate said at least one crossing warning device, the positive train control system constituting a primary activation-signal source for activating said at least one crossing warning device.

3. The railway road crossing warning system of claim 2, wherein the railway-vehicle sensing system constitutes a secondary activation-signal source for activating said at least one crossing warning device in the event the activation signal from the positive train control system is unavailable.

* * * * *